United States Patent [19]

Kreuter

[11] Patent Number: 4,715,331

[45] Date of Patent: Dec. 29, 1987

[54] ELECTROMAGNETICALLY-ACTUATED POSITIONING MECHANISMS

[76] Inventor: Peter Kreuter, Josef-Ponten Str. 38, Aachen 5100, Fed. Rep. of Germany

[21] Appl. No.: 850,936

[22] Filed: Apr. 11, 1986

[30] Foreign Application Priority Data

Apr. 12, 1985 [DE] Fed. Rep. of Germany ..... 3513106

[51] Int. Cl.[4] ..... F01L 9/04; H01F 7/08

[52] U.S. Cl. ..... 123/90.11; 251/129.1; 251/129.16; 251/129.18; 335/266

[58] Field of Search ..... 123/90.11; 251/129.09, 251/129.1, 129.16, 129.18; 335/256, 258, 262, 266, 268

[56] References Cited

U.S. PATENT DOCUMENTS 2,989,666 6/1961 Brenner et al. ..... 335/268 X 4,455,543 6/1984 Pischinger et al. ..... 335/266

*Primary Examiner*—Tony M. Argenbright

*Attorney, Agent, or Firm*—Jacques M. Dulin

[57] ABSTRACT

A solenoid insulation system for an electromagnetic positioning mechanism for reciprocating valve actuators which are shifted between two positions by means of actuating solenoids and are maintained under load between their operating positions by a spring system. In the operational state, the locus of equilibrium of the spring system is determined by an adjusting solenoid which may be integral with or closely adjacent to the actuating solenoid(s). Pursuant to the invention, the adjusting solenoid's magnetic field is decoupled to the greatest possible degree from that of the actuating solenoids. In this manner, uncontrolled operating states of the actuating solenoid are avoided. Decoupling insulation is provided by suitable air gap(s), diamagnetic or paramagnetic material, or constructing the core of the adjusting solenoid from material different than the actuating solenoid, e.g., transformer sheet and sintered ferrite core material respectively.

20 Claims, 2 Drawing Figures

ELECTROMAGNETICALLY-ACTUATED POSITIONING MECHANISMS

FIELD

The invention concerns solenoid insulation systems for an electromagnetically-actuated positioning mechanism for spring-biased reciprocating actuators in displacement machines, more particularly in lifting valves in internal combustion engines. Such positioning mechanisms have a spring system and two opposed electrically-controlled actuating solenoids which alternately move a valve actuator assembly between two discreet, mutually opposite operating positions, such as valve open and valve closed positions of an intake and/or exhaust valve of an internal combustion engine. When energized, the actuating solenoid holds the actuator assembly in the selected operating position for the predetermined desired time for proper engine operation. The spring system has a locus of equilibrium between the two actuating solenoids. The positioning mechanism also includes an adjusting solenoid which is disposed to shift the spring system equilibrium locus from a point centered between the operating positions, to another non-central point. The improved solenoid insulation system of this invention particularly concerns providing magnetic resistance between the adjusting solenoid and one of the actuating solenoids, the two of which may be of integral construction or closely associated. The insulation system of the invention inhibits uncontrolled operating behavior of the actuating solenoid.

BACKGROUND

A comparable positioning system is known from the DE-OS No. 30 24 109 corresponding to U.S. Pat. No. 4,455,543.

The state of the art describes an actuator which is shifted back and forth between two operating positions by the alternating energizing of two actuating solenoids. An additional adjusting solenoid is provided for system startup. This adjusting solenoid is located adjacent to one of the actuating solenoids and shifts the seat of a spring system which loads the actuator system, in order to adjust the locus of equilibrium of the spring system.

With this arrangement, however, the actuating solenoid, which defines the "closed" position of the actuator, shows an uncontrolled behavior, due to interference of the magnetic fields of the two solenoids. Some examples of uncontrolled behavior which may occur include incomplete valve actuator travel preventing complete valve closure or opening, premature attraction or release of the valve actuator assembly, increase or decrease in field strength of the actuating solenoid causing valve timing delays, and the like. Such behavior may result in rough engine operation and reduced performance.

Accordingly, there is a need in the art to provide a system for reducing the uncontrolled behavior of such actuating solenoids.

THE INVENTION

Objects:

It is among the objects of the invention to provide a solenoid insulation system which reduces or eliminates the uncontrolled behavior of the actuating solenoid.

It is another object of the invention to provide an insulation system for closely associated or integral actuating and adjusting solenoids in electromagnetically-actuated positioning systems for spring-biased reciprocating actuators in displacement machines, such as lifting valves in internal combustion engines.

It is another object of the invention to reduce the uncontrolled behavior of valve closure actuating solenoids in displacement machines by providing magnetic insulation between adjacent actuating and adjusting solenoids.

It is another object of the invention to provide a magnetic insulation system between adjacent actuating and adjusting solenoids in internal combustion engine valve actuator positioning mechanisms which serve to isolate and confine the magnetic fields to their respective source solenoids so that they do not interfere with each other, such as by use of an air gap, diamagnetic or paramagnetic materials, or use of different magnet core materials.

Still other objects will be evident from the specification, drawing and claims.

THE DRAWINGS

FIG. 1 shows a side view, partly in section, of an electromagnetically-actuated valve positioning system which employs the magnetic insulation system of the invention disposed between the adjusting and the valve closure actuator solenoid; and FIG. 2 shows an enlarged detail in section, with valve and associated spring eliminated, of another embodiment of the solenoid insulation/isolation system of the invention.

SUMMARY

Pursuant to the invention, a magnetic gap between the core of the actuating solenoid and the core of the adjusting solenoid is provided to separate (decouple) the magnetic fluxes of the two cores. This magnetic gap does not necessarily have to be an air gap; diamagnetic or paramagnetic materials may be inserted, but the magnetic lines of force must not be conducted from the actuating solenoid core to the adjusting solenoid core by a ferromagnetic material.

In this manner, the magnetic field set up by the coil of the adjusting solenoid does not influence the actuating solenoid, and thereby does not lead to undesirable interference with the magnetic field set up by the actuating solenoid coil. It is of particular importance that the actuating solenoid show very rapid decay times, which are negatively influenced by the effects of the adjusting solenoid's magnetic field on the actuating solenoid's coil.

Likewise, prevention of mutual influence is preferentially achieved by the use of differing magnet core materials. In this manner, the magnet core material can be matched to the required characteristics of the solenoid in question. While the adjusting solenoid maintains a stationary magnetic field, the actuating solenoid must be continuously switched on and off. Dynamic eddy current losses are correspondingly noncritical in the case of the adjusting solenoid, which may thus be fabricated using (for example) transformer sheet of soft iron.

However, transformer sheet is unsuited for the actuating solenoid as the magnetic field must decay very rapidly when the valve operating position is reversed. A low eddy current core material such as sintered material is preferable in the case of the actuating solenoid. The sintered material may be a ferrite, for example, powdered iron.

For construction reasons, such as ease and precision of manufacture and assembly, it is nonetheless desirable that the two separate solenoids form a single unit. One method of joining the two different core materials is by electron beam welding. In this case, local heating only takes place, so that the material properties of the core material are not negatively affected.

DETAILED DESCRIPTION OF THE BEST MODE OF THE INVENTION

In the following detailed description, the invention shall be explained with reference to the figures. This description is by way of example and not by way of limitation of the principles of the invention.

Figure 1:
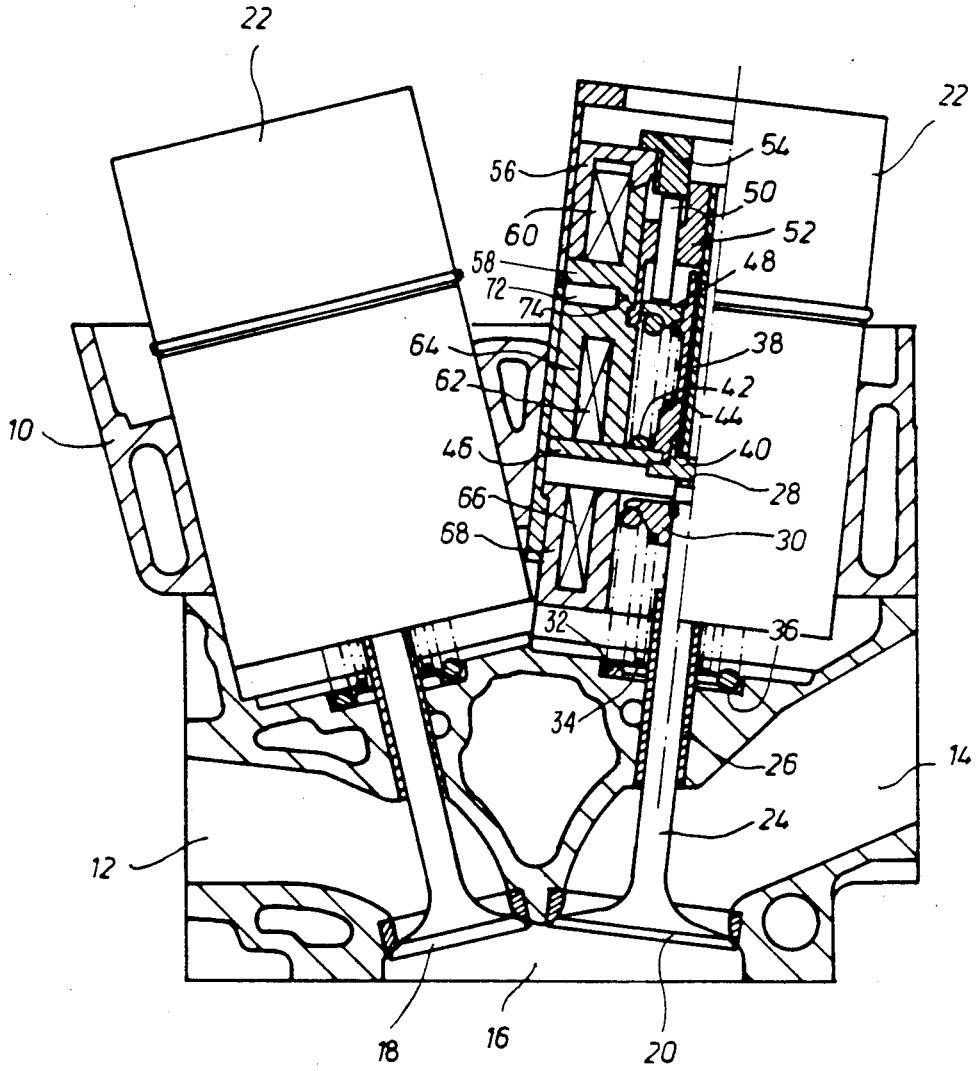

FIG. 1 illustrates a cross-section of an engine block of an internal combustion engine. Item 10 indicates the cylinder head. An intake port 12, which may be selectively closed with an intake valve 18, leads into cylinder bore 16. An exhaust port 14, which may be selectively closed with an exhaust valve 20, lead out of cylinder bore 16. Valves 18 and 20 are actuated by an electromagnetic positioning system situated in housing 22. The unit situated in housing 22 is preferably identical for both intake and exhaust valves, in order to reduce the range of parts required. Nonetheless, it is possible to match intake and exhaust valve characteristics to specific design requirements. It may thus be observed in FIG. 1 that the disk of exhaust valve 20 is larger than the disk of intake valve 18.

As there is no theoretical difference between intake and exhaust valve construction, the following discussion will refer to the exhaust valve only.

Valve disk 20 is integral with valve stem 24 which slides in valve guide 26, inserted in cylinder head 10. The end of valve stem 24, indicated as Item 28, has a bearing surface which contacts a tappet 40, to be described below.

A flange 30 is circumferentially mounted on the end of valve stem 24 opposite valve disk 20. Flange 30 acts as a seat for a spring system consisting of a large spiral spring 32 and a small spiral spring 34. Both spiral springs 32 and 34 are coaxially installed. The opposite spring seat is formed by a bearing surface in the cylinder head. Valve stem 24 may be actuated in valve guide 26 against the loading of springs 32 and 34, causing valve disk 20 to rise off its seat and open exhaust port 14.

An axial extension to valve stem 24 is formed by actuator rod 38, the lower end of which is fitted with tappet 40, which makes contact with valve stem 26. An annular anchor plate 46, made of ferromagnetic material, is fastened to actuator rod 38 in the region of tappet 40. This anchor plate also supports a spring system consisting of a large spiral spring 42 and small spiral spring 44, which are also coaxial to one another and to rod 38.

The seat for this loading system 42 and 44 is formed by a support 48, to be described in greater detail.

A magnet core 68 having a U-shaped cross-section is annularly installed, the axis of the annulus coinciding with the axis of valve stem 24. A coil 66 is situated inside magnet core 68. The open side of U-sectioned magnet core 68 faces in the direction of the anchor plate.

Actuator rod 38 is likewise surrounded by a similarly-shaped magnet core 64, inside of which is a coil 62. As solenoids 62 and 66 are alternately energized, anchor plate 46 moves from a contact face on magnet core 64 to a contact face on magnet core 68, and back again.

Also provided is an adjusting solenoid consisting of a magnet core 58 and a coil 60. Energizing coil 60 attracts ferromagnetic component 56, which is joined to part 54. This movement, caused by energized adjusting solenoid coil 60 and acting on part 54, is transmitted by means of pin 50, placed in a cover plate, to the spring-system seat formed by a ring 30, whereby energizing adjusting solenoid coil 60 shifts the seal (support 48) of springs 42 and 44.

Upon positioning system startup, coil 60 is energized, thereby attracting ferromagnetic component 56. This results in the passage of magnetic flux through core 58, the sole function of which is to attract ferromagnetic component 56 and thereby shift the seat of the spring system.

Actuating solenoids 62 and 66 are independent of adjusting solenoid 60; the magnetic fields induced by solenoids 62 and 66 act on cores 64 and 68, respectively. In view of the rapid actuating times of the control component, it is important that the magnet field of coil 62 be able to decay speedily. A magnetic field acting on core 64 through coil 60 and core 58 is detrimental to this rapid decay time. A gap 72 has therefore been provided between core 58 and core 64, forming a shield between the two cores and suppressing mutual magnetic effects. Gap 62 may be an air gap or may, of course, consist of a non-ferromagnetic material; the important factor is that magnetic lines of force be prevented from moving unhindered from core 58 to core 64.

To facilitate assembly, both core units 58 and 64 may be joined together, e.g., by means of an electron beam weld seam 74. Other joining techniques, such as adhesive bonding, are also possible.

The materials used for coil unit 58 may differ from those used for coil unit 64. Solenoid 60 performs an essentially steady-state function: it must shift the spring system bearing surface upon commencement of operation, and thus remains energized throughout the operation of the device. Dynamic engagement and release processes are thus of secondary significance. The important factors are the solenoid's strong magnetic field and a core which ensures development of high magnetic strength, such as transformer sheet.

Contrasting requirements are observed for the material used in core 64 of actuating solenoid 62. In this case, dynamic processes are overwhelmingly important, as very short actuating times—particularly release times—are required. The application thus calls for the least possible propagation of eddy currents, which prolong actuating times; as a result, suppression of eddy currents is a criterion for core material selection. This may be achieved through appropriate design, e.g., using additional air gaps; sintered ferrite cores capable of carrying a magnetic field have also demonstrated their suitability.

Figure 2:
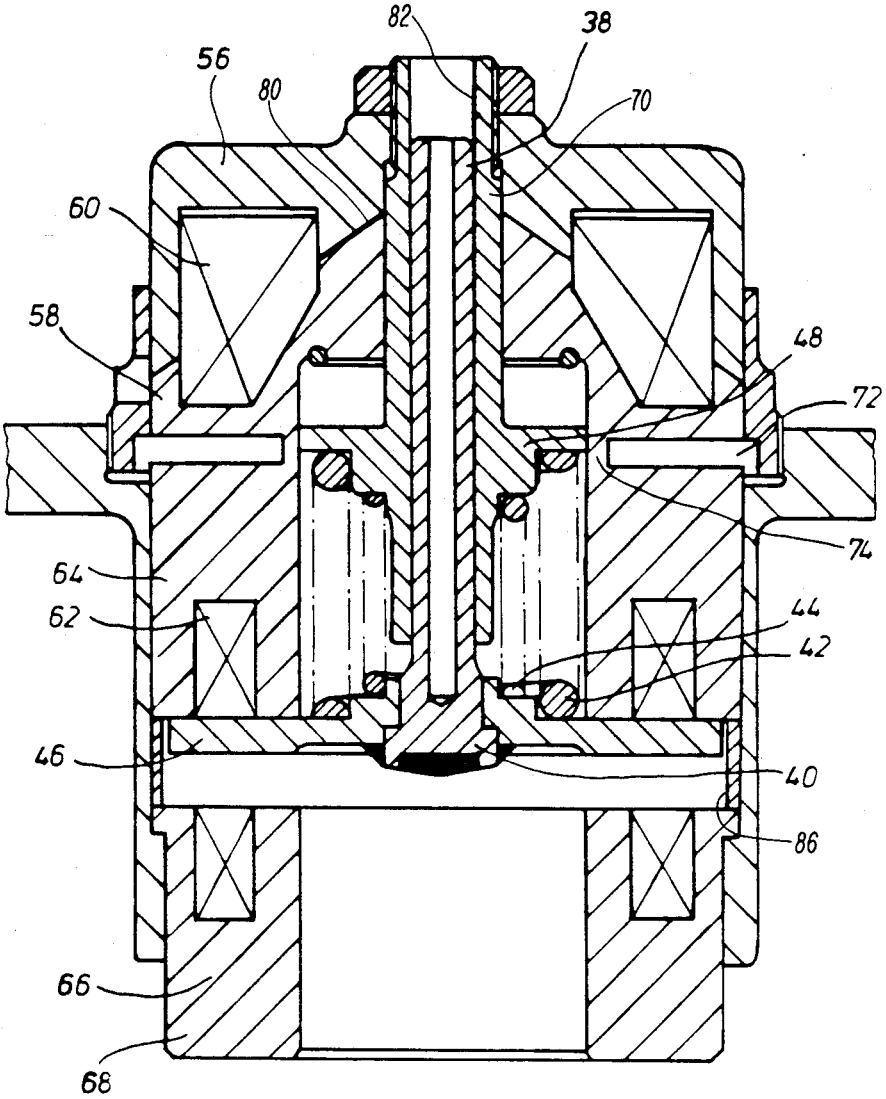

FIG. 2 illustrates another embodiment which differs from that shown in FIG. 1 primarily in the constructional features of the adjusting solenoid and the transmission of movement from ferromagnetic component 56 to support 48 of spring system 42 and 44. For clarity, a portion of the system—namely, actuated valve 20 and its spring system—has been omitted. The cross-sectional drawing thus gives a better picture of magnetic gap 72 and the joint between core 64 and core 58. The numbered parts are as described in FIG. 1. For details of the functioning of guide and centering system provided by rod 38 moving in bore 82 of sleeve 70 and guideway 86, see my copending case, Ser. No. 850,937, now U.S. Pat. No. 4,671,523, issued June 9, 1987 (not assigned, filed of even date herewith, the disclosure of which is incorporated by reference.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification if need be.

I claim:

1. A solenoid insulation system for an electromagnetically-actuated positioning mechanism for a valve-type reciprocating actuator assembly for actuating a valve member in a displacement machine, comprising in operative combination:

(a) at least one adjustable spring disposed between and bearing on a first and a second spaced-apart seat member;

(b) at least one actuating solenoid having a core disposed to selectively attract a single guided ferromagnetic valve actuator member to a first operating position;

(c) said ferromagnetic valve actuator member being disposed across the face of said actuating solenoid and contactable with but disconnected from said valve member, and comprising said first spring seat member;

(d) said spring being disposed coaxial to said actuating solenoid in a bore provided therein and disposed in contact with said ferromagnetic valve actuating member on one side thereof to urge it toward contact with said valve member;

(e) at least one adjusting solenoid having a core disposed in association with said actuator assembly adapted to adjust the position of said second spring seat member; and (f) said actuating solenoid core and said adjusting solenoid core are disposed with respect to each other to provide magnetic resistance therebetween to substantially decouple the respective cores of said solenoids.

2. A solenoid insulation system as in claim 1 wherein:

(a) said actuating solenoid core and said adjusting solenoid cores comprise different materials capable of carrying a magnetic field.

3. A solenoid insulation system as in claim 2 wherein:

(a) said actuating solenoid core material comprises a sintered magnetic field-carrying material.

4. A solenoid insulation system as in claim 3 wherein:

(a) the adjusting solenoid core material comprises transformer plate material.

5. A solenoid insulation system as in claim 2 wherein:

(a) said differing core materials are joined by an electron beam weld.

6. A solenoid insulation system as in claim 4 wherein:

(a) said solenoid insulation system is disposed in association with at least one gas exchange valve electromagnetically-actuated positioning mechanism in an internal combustion engine.

7. A solenoid insulation system as in claim 5 wherein:

(a) said solenoid insulation system is disposed in association with at least one gas exchange valve electromagnetically-actuated positioning mechanism in an internal combustion engine.

8. A solenoid insulation system as in claim 1 wherein:

(a) said solenoid cores are disposed separated substantially from each other by an air gap.

9. A solenoid insulation system as in claim 8 wherein:

(a) said actuating solenoid core and said adjusting solenoid cores comprise different materials capable of carrying a magnetic field.

10. A solenoid insulation system as in claim 8 wherein:

(a) said actuating solenoid core material comprises a sintered magnetic field-carrying material.

11. A solenoid insulation system as in claim 8 wherein:

(a) the adjusting solenoid core material comprises transformer plate material.

12. A solenoid insulation system as in claim 11 wherein:

(a) said solenoid insulation system is disposed in association with at least one gas exchange valve electromagnetically-actuated positioning mechanism in an internal combustion engine.

13. A solenoid insulation system as in claim 8 wherein:

(a) said differing core materials are joined by an electron beam weld.

14. A solenoid insulation system as in claim 1 wherein:

(a) said solenoid cores are disposed separated substantially from each other by a material selected from a paramagnetic material and a diamagnetic material.

15. A solenoid insulation system as in claim 14 wherein:

(a) said actuating solenoid core and said adjusting solenoid cores comprise different materials capable of carrying a magnetic field.

16. A solenoid insulation system as in claim 14 wherein:

(a) said actuating solenoid core material comprises a sintered magnetic field-carrying material.

17. A solenoid insulation system as in claim 14 wherein:

(a) the adjusting solenoid core material comprises transformer plate material.

18. A solenoid insulation system as in claim 17 wherein:

(a) said solenoid insulation system is disposed in association with at least one gas exchange valve electromagnetically-actuated positioning mechanism in an internal combustion engine.

19. A solenoid insulation system as in claim 14 wherein:

(a) said differing core materials are joined by an electron beam weld.

20. A solenoid insulation system as in claim 1 wherein:

(a) said solenoid insulation system is disposed in association with at least one gas exchange valve electromagnetically-actuated positioning mechanism in an internal combustion engine.

* * * * *